US005340083A

United States Patent [19]

Suhy et al.

[11] Patent Number: 5,340,083

[45] Date of Patent: Aug. 23, 1994

[54] POOL TABLE SLATE LIFTER

[76] Inventors: David R. Suhy, 22122 Covello St., Canoga Park, Calif. 91303; David J. Suhy, 7601 Kelvin Ave., Canoga Park, Calif. 91306; Richard C. Suhy, 22122 Covello St., Canoga Park, Calif. 91303

[21] Appl. No.: 58,516

[22] Filed: May 4, 1993

[51] Int. Cl.[5] ..... B66F 3/36

[52] U.S. Cl. ..... 254/100; 473/4

[58] Field of Search ..... 273/5 B, 3 C; 254/100, 254/8 R; 29/256, 257, 258, 259

[56] References Cited

U.S. PATENT DOCUMENTS

| | | | |
|---|---|---|---|
| 829,344 | 8/1906 | Larson | 254/100 |
| 1,254,797 | 1/1918 | Gries | 254/100 |
| 1,828,758 | 10/1931 | Zimmerman | 29/256 |
| 2,456,375 | 12/1948 | Cedarholm | 254/100 |
| 2,504,201 | 4/1950 | Johnson | 254/100 |
| 5,125,626 | 6/1992 | Lonsway et al. | 254/8 R |
| 5,152,044 | 10/1992 | Bales | 29/257 |

*Primary Examiner*—Robert C. Watson

*Attorney, Agent, or Firm*—Rapkin, Gitlin & Moser

[57] ABSTRACT

The present invention comprises a device that is clamped to the pool table slate through the opening in either of the table's side pockets. The invention also incorporates a threaded shaft which passes through a threaded element to which the principal portion of the device is attached. The lower end of the threaded shaft is fitted with a pilot pin. The pilot pin engages a pivot point formed within the upper surface of a device that is clamped to the pool table edge at the site of the opening of the side pocket. The other end of the threaded shaft is fitted with a handle for rotating the shaft. Depending on which direction the shaft is rotated, the slate can either be raised or lowered.

1 Claim, 4 Drawing Sheets

POOL TABLE SLATE LIFTER

BACKGROUND OF INVENTION

This invention relates generally to the lifting of Pool Table Slates, particularly, but not limited to, the coin operated type.

Heretofore, persons needing to raise the slate of a pool table to perform maintenance or re-covering with new felt had to do so by means of hand lifting. This can be very harmful to the person's back and slippage could cause severe injury to the person's hand and fingers, since the slate is extremely heavy.

To provide a safe and simple means to accomplish this, a screw type jack has been utilized. Unlike all other screw type jacks, this particular one is configured with a clamping device that is clamped tot he pool table slate through the opening of the side pocket of the pool table. The screw jack incorporates a threaded shaft which passes through a threaded element to which the clamping device is attached. The lower end of the threaded shaft is fitted with a pivot point. This pivot point is inserted into a device that is clamped to the pool table edge at the side pocket opening of the pool table. The other end of the threaded shaft is fitted with a handle for rotating the shaft. Depending on which direction the shaft is rotated, the slate is raised or lowered.

SUMMARY OF INVENTION

The present invention comprises a device that is clamped to the pool table slate through the opening in either of the table's side pockets. The invention also incorporates a threaded shaft which passes through a threaded element to which the principal portion of the device is attached. The lower end of the threaded shaft is fitted with a pilot pin. The pilot pin engages a pivot point formed within the upper surface of a device that is clamped to the pool table edge at the site of the opening of the side pocket. The other end of the threaded shaft is fitted with a handle for rotating the shaft. Depending on which direction the shaft is rotated, the slate can either be raised or lowered.

Accordingly, it is the object of this invention to provide a safe, simple and convenient means to lift the slate of a pool table with a screw type jack that is efficient and reliable in its operation and relatively simple and inexpensive to manufacture.

A feature of this invention is the pivoting trunnion block and the pivoting lower end of the screw shaft to compensate for the changes in the angle of the pool table slate as it is being raised and lowered, which also contributes to the safety factor.

Another feature of this invention is the compact size, partially due to the clamping device used on the table edge, thus eliminating the need for cumbersome floor mounted supports.

Although the description above contains many specifications, these should not be construed as limiting the scope of the invention but as merely providing illustrations of some of the presently preferred embodiments of this invention. For example, the turning of the shaft may be motorized in addition to hand rotation, etc.

Thus the scope of the invention should be determined by the appended claims and their legal equivalents, rather than by the examples given.

DETAILED DESCRIPTION OF THE ILLUSTRATED EMBODIMENT

Figure 1:
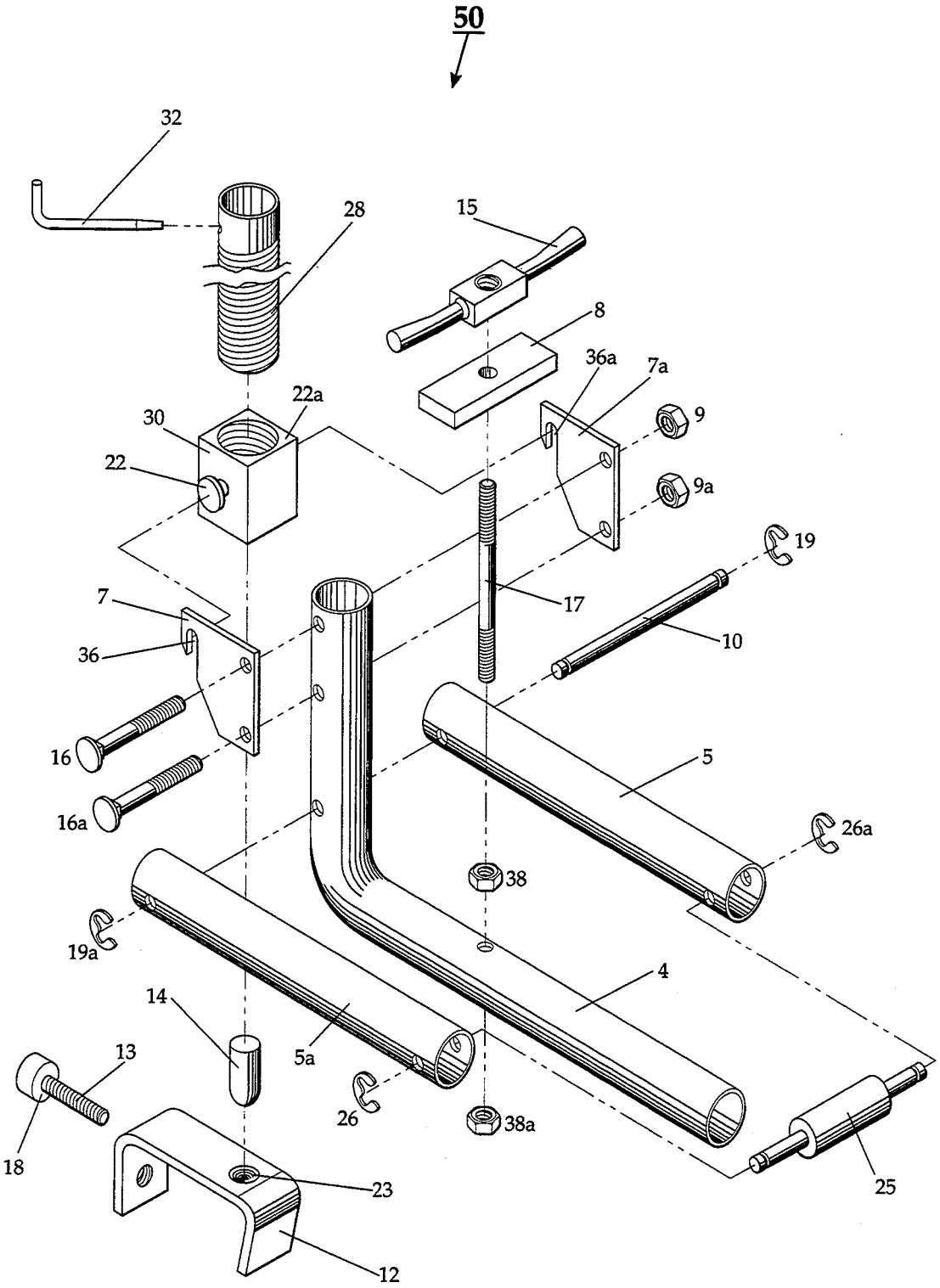
FIG. 1 is an exploded view of the device in accordance with the present invention.
Figure 2:
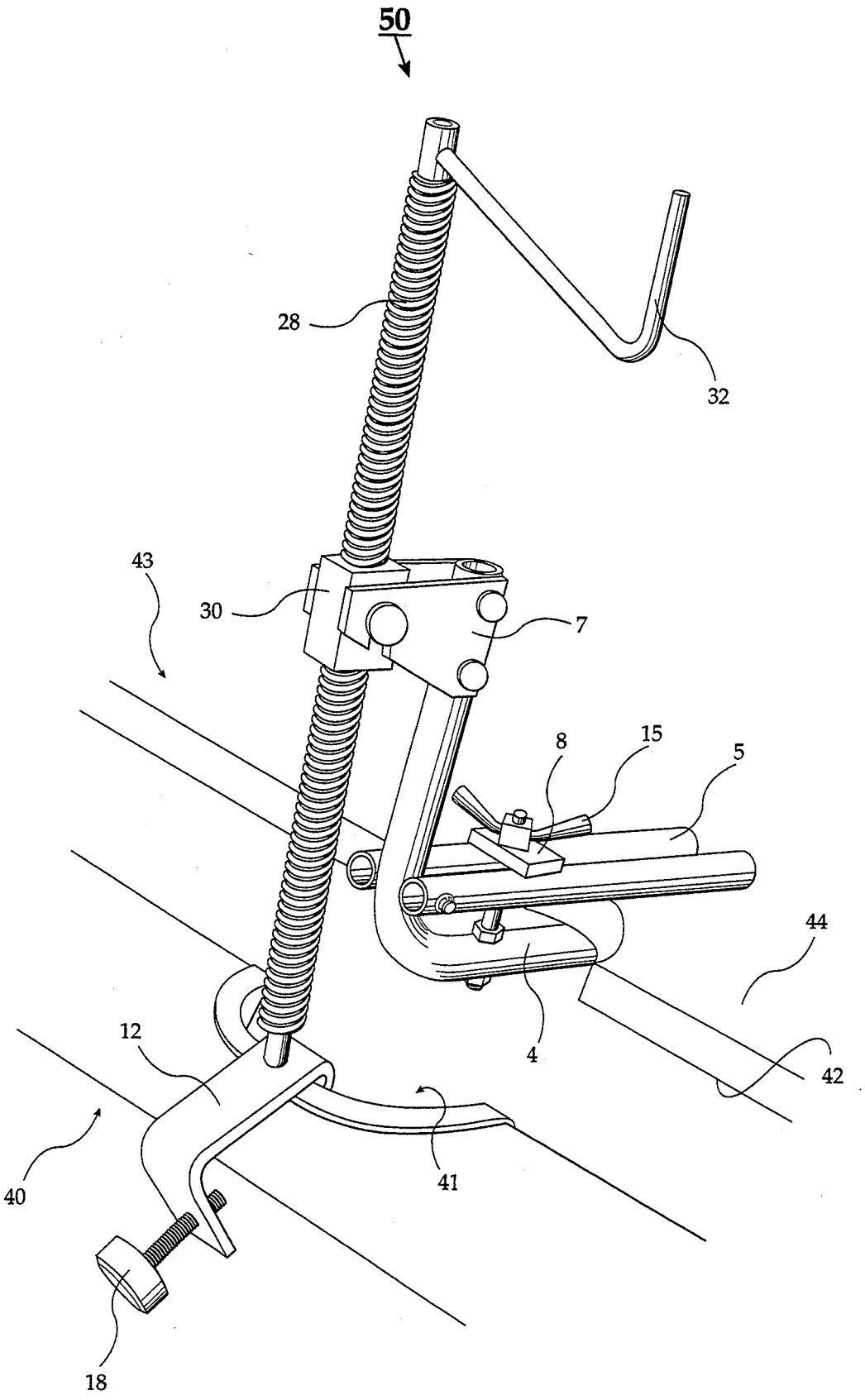
FIG. 2 is a perspective view of the device in accordance with the present invention shown attached to a conventional pool table.
Figure 3:
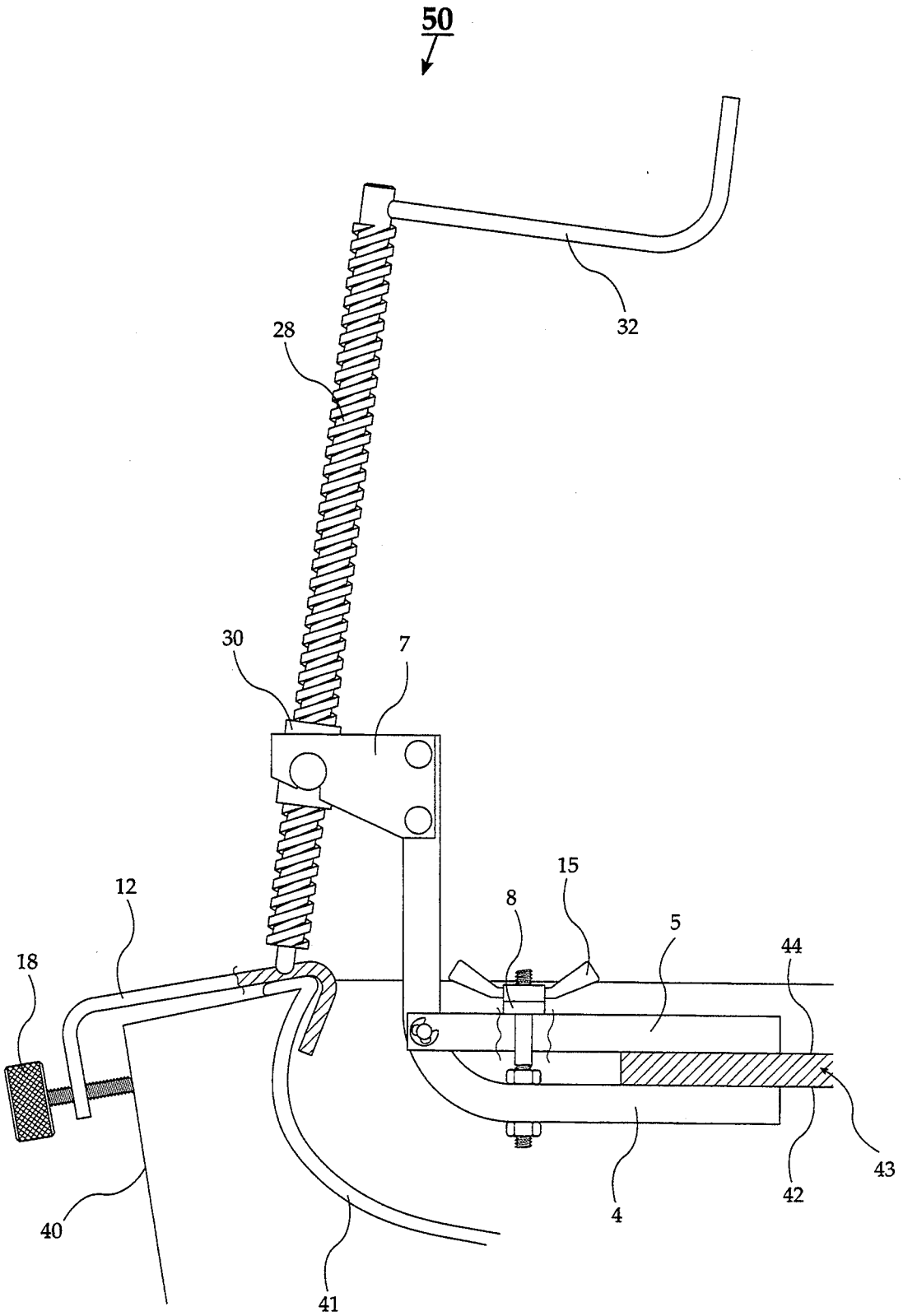
FIG. 3 is a side elevational view of the device in accordance with the present invention shown attached to a conventional pool table.
Figure 4:
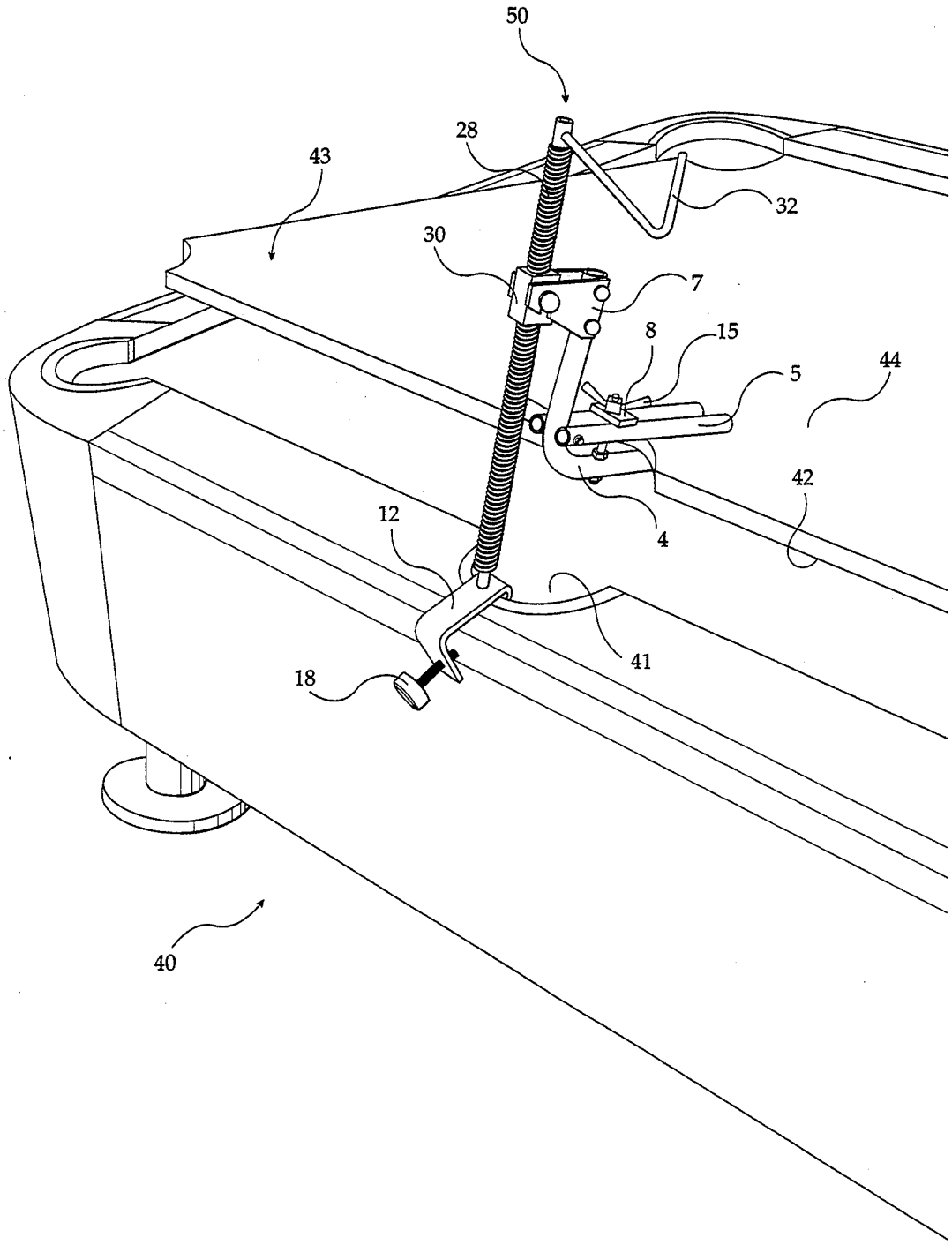
FIG. 4 is a perspective view of the device in accordance with the present invention shown engaging and lifting the playing surface of a conventional pool table.

Referring now to the drawing FIG. 1 there is shown a screw lifting jack constructed in accordance with the principles of this invention and designated generally by reference numeral 50. The screw lifting jack 50 includes a vertical main threaded shaft 28 and extends through an internally threaded trunnion block 30 which moves up and down the threaded shaft 28 depending on which direction the handle 32 is rotated. The bottom end of the threaded shaft 28 has been fitted with a pilot pin 14. A pivot point 23 is formed into the top surface of the table clamp 12.

Table clamp 12 is positioned on the edge of the pool table 40 at the site of the side pocket 41 and tightened with screw 13 by rotating the screw knob 18.

The stationary lower clamp arm 4 is attached to and positioned between main support plates 7 and **7*a* by means of two bolts 16 and 16*a* retained by two nuts 9 and 9*a*. This lower clamp arm 4 is inserted into the side pocket 41 of the pool table 40 and engages the underside 42 of the pool table 40 playing surface 43 or slate, as it is commonly called. The upper moveable clamp arms 5 and 5*a* are attached to either side of the stationary lower clamp 4 by means of the rearward pin 10 and retainers 19 and 19*a*. The upper moveable clamp arms 5 and 5*a* are then positioned on the top side 44 of the playing surface 43. The clamping action engages by rotating the clamping plate 8, which floats freely along a threaded rod 17. Rod 17 is secured to the stationary lower clamp 4 by means of nuts 38 and 38*a*. Clamping plate 8 continues to be rotated until it is in a position perpendicular and across the top of clamp arms 5 and 5*a*. Tightening or loosening the clamping plate 8 is now achieved by rotating the threaded clamp handle 15, thus applying pressure to the clamping plate 8 and transferring the pressure to the upper clamp arms 5 and 5*a*. The upper clamp arms 5 and 5*a* are held together by means of the upper clamp forward pin 25 and retainers 26 and 26*a***.

The main support plates 7 and **7*a* include slotted holes 36, 36*a*. Slotted holes 36, 36*a* slip respectively over the pivot pins 22 and 22*a*, which are an integral part of the trunnion block 30. With the playing surface 43 of the pool table 40 now being clamped between the lower clamp arm 4 and the upper movable clamp arms 5, 5*a*, and the pilot pin 14 of the main threaded shaft 28 now inserted into the pivot point 23 of the table clamp 12, the handle 32 is then rotated. This causes the trunnion block 30 to raise, thus transferring the lifting energy to the main support plates 7 and 7*a*. This, in turn, raises the stationary lower clamp 4 which, in the process of engaging the underside 42 of the playing surface 43, will now lift the playing surface 43 of the pool table 40 on one edge, allowing access to ample work space under the playing surface 43**.

4 Stationary lower clamp arm

5 & 5*a* Moveable upper clamp arms
7 & 7*a* Main support plates
8 Clamp plate
9 & 9*a* Bolt fasteners
10 Upper clamp arm rearward pin
12 Table clamp
13 Table clamp adjusting screw
14 Pilot pin
15 Threaded clamp handle
16 & 16*a* Bolt
17 Threaded rod
18 Adjusting screw knob
19 & 19*a* 26 & 26*a* retainers
22 & 22*a* Pivot Pins
23 Pivot Point
25 Upper clamp arm forward pin
28 Main threaded shaft
30 Trunnion block
32 Handle
36 & 36*a* Slotted Hole
38 & 38*a* Threaded rod nuts

We claim:

1. In combination with a billiard table having a generally rectangular frame with four corners and four side walls, each of said side walls including an outside surface and an inside surface, a playing surface with an upper side and a lower side and four edges, and a plurality of pocket holes, including corner pocket holes located at the corners of the playing surface and at least one side pocket hole located along each of said side walls situated in spaced apart opposed relation to one another at approximately the mid point thereof, a device for lifting and lowering one edge of said playing surface in a generally vertical direction to gain access thereunder, comprising, an L-shape arm member adapted toe inserted into one of said side pocket holes to engage and support the lower side of said playing surface, said L-shape arm member including a vertical member, a horizontal member and a pivot point located generally along said vertical member, a pair of arms pivotally attached in spaced apart relation to said L-shape arm member at the site of said pivot point, said pair of arms adapted to engage the upper side of the playing surface and, in combination with said L-shape arm member, form a clamping assembly for tightly grasping the playing surface, a pair of support plate members fixedly attached to said vertical member on opposite sides thereof in parallel relation, each of said plate members having a slot-like opening formed at one end, an elongated threaded shaft member having a top end and a bottom end with a handle means attached at the top end and a pivot pin means formed at the bottom end, a clamp member adapted for attachment to the sidewall of said billiard table at the site of one of said side pocket holes, said clamp member having an upper surface with a pivot area formed therein for pivotally and rotatably supporting the pivot pin means, a trunnion member having a threaded aperture for receiving said threaded shaft member in rotating relation and at least two projecting support pins for engaging the respective said slot-like openings formed in each of said support plate members, and said threaded shaft member being rotatable in either a clockwise or counter-clockwise direction to engage the threaded aperture in said trunnion member for raising or lowering said clamping assembly and controlling the elevation of the playing surface, said threaded shaft member in association with said pivot area and said trunnion member in rotating engagement with said support plate members adapted to adjust their rotation to compensate for the changes in the angle of the playing surface as it is raised and lowered.

* * * * *

UNITED STATES PATENT AND TRADEMARK OFFICE

CERTIFICATE OF CORRECTION

PATENT NO. : 5,340,083

DATED : August 23, 1994

INVENTOR(S) : SUHY, David R.; SUHY, David J.; SUHY, Richard C.

It is certified that error appears in the above-identified patent and that said Letters Patent is hereby corrected as shown below:

Column 3, Line 37:

delete "toe".
add "to be".

should read "an L-shape arm member adapted to be inserted into one"

Signed and Sealed this

First Day of November, 1994

Bruce Lehman

*Attest:*

BRUCE LEHMAN

*Attesting Officer*

*Commissioner of Patents and Trademarks*